United States Patent [19]

Jonkouski

[11] Patent Number: 4,979,747

[45] Date of Patent: Dec. 25, 1990

[54] GOLF BALL

[75] Inventor: Gail C. Jonkouski, Chicago, Ill.

[73] Assignee: Wilson Sporting Goods Co., River Grove, Ill.

[21] Appl. No.: 457,490

[22] Filed: Dec. 27, 1989

[51] Int. Cl.[5] ..... A63B 37/12

[52] U.S. Cl. ..... 273/232

[58] Field of Search ..... 273/232

[56] References Cited

U.S. PATENT DOCUMENTS

| | | | |
|---|---|---|---|
| 878,254 | 2/1908 | Taylor | 273/232 |
| 4,090,716 | 5/1978 | Martin et al. | 273/232 |
| 4,560,168 | 12/1985 | Aoyama | 273/232 |
| 4,681,323 | 7/1987 | Alaki et al. | 273/232 |
| 4,720,111 | 1/1988 | Yamada | 273/232 |
| 4,729,567 | 3/1988 | Oka et al. | 273/232 |
| 4,744,564 | 5/1988 | Yamada | 273/232 |
| 4,787,638 | 11/1988 | Kobayashi | 273/232 |
| 4,804,189 | 2/1989 | Gobush | 273/232 |
| 4,813,677 | 3/1989 | Oka et al. | 273/232 |
| 4,840,381 | 6/1989 | Ihara et al. | 273/232 |

*Primary Examiner*—George J. Marlo

[57] ABSTRACT

A golf ball is provided with five sets of dimples, the dimples of each set having a different diameter and a different depth. As the diameter of the dimples decreases, the depth of the dimples increases, and the aspect ratio of the depth to diameter for each set is within the range of 0.025 to 0.055 inch. The side surface of each dimple is formed by a frustum of a cone.

15 Claims, 7 Drawing Sheets

---- GREAT CIRCLE ——— ICOSAHEDRAL TRIANGLE BOUNDARY

| DIMPLE POSITION | CHORD (IN.) | DEPTH (IN.) |
|---|---|---|
| 1 | .155 | .0050 |
| 2 | .150 | .0052 |
| 3 | .140 | .0054 |
| 4 | .135 | .0056 |
| 5 | .125 | .0060 |

PRIOR ART

---- GREAT CIRCLE

——— ICOSAHEDRAL TRIANGLE BOUNDARY

| DIMPLE POSITION | CHORD (IN.) | DEPTH (IN.) |
|---|---|---|
| 1 | .135 | .0070 |
| 2 | .135 | .0070 |
| 3 | .135 | .0070 |
| 4 | .135 | .0070 |
| 5 | .135 | .0070 |
| 6 | .135 | .0070 |
| 7 | .135 | .0070 |

PRIOR ART

PRIOR ART

---- GREAT CIRCLE

——— ICOSAHEDRAL TRIANGLE BOUNDARY

| DIMPLE POSITION | CHORD (IN.) | DEPTH (IN.) |
|---|---|---|
| 1 | .155 | .0071 |
| 2 | .150 | .0069 |
| 3 | .140 | .0064 |
| 4 | .135 | .0062 |
| 5 | .125 | .0058 |

PRIOR ART

---- GREAT CIRCLE

——— ICOSAHEDRAL TRIANGLE BOUNDARY

| DIMPLE POSITION | CHORD (IN.) | DEPTH (IN.) |
|---|---|---|
| 1 | .155 | .0050 |
| 2 | .150 | .0052 |
| 3 | .140 | .0054 |
| 4 | .135 | .0056 |
| 5 | .125 | .0060 |

GOLF BALL

BACKGROUND

This invention relates to a golf ball, and, more particularly, to a golf ball which is provided with a new and unique dimple pattern which provides excellent distance and accuracy.

This invention represents an improvement over the golf ball dimple patterns which are described in U.S. Pat. No. 4,560,168 and the golf ball dimple pattern which is used on the commercial golf ball sold under the name Wilson Staff.

U.S. Pat. No. 4,560,168 describes various icosahedral dimple patterns in which the dimples are arranged so that they do not intersect the six great circles which bisect the sides of the icosahedral triangles. The dimple pattern illustrated in FIGS. 8A and 8B is used on commercial golf balls which are sold under the name Ultra. The Ultra golf ball is a two-piece golf ball which consists of a solid core and a cover. The Ultra dimple pattern includes 432 dimples, and each dimple has the same diameter and depth.

The Wilson Staff golf ball is a three-piece golf ball which includes a solid core, a layer of elastic windings which are wrapped around the core, and a cover. The dimple pattern of the Wilson Staff ball is a 432 dimple pattern which is similar to the Ultra pattern except that there are four different sized dimples and the dimples are frusto-conical rather than spherical. The five dimple diameters are 0.155, 0.150, 0.140, 0.135, and 0.125 inches. The aspect ratio is determined by dividing the depth of the dimple by the diameter of the dimple, and the aspect ratio for all of the Wilson Staff dimples is 0.046. The depths of the dimples are therefore 0.0071, 0.0069, 0.0064, 0.0062, and 0.0058 inches, respectively.

The Wilson Staff dimples are frusto-conical rather than spherical, i.e., the side surface of each dimple is formed by the frustum of a cone or a truncated cone rather than by a portion of a sphere. Prior golf balls sold under the name Pro Staff also utilized frusto-conical dimples. The bottom surface of each Wilson Staff dimple is flat and the depth of the dimple is measured to the bottom surface.

A dimple pattern formed by dimples having different diameters and a constant aspect ratio performs satisfactorily when used on a three-piece golf ball such as the Wilson Staff ball. However, such a dimple pattern does not perform satisfactorily when used on a two-piece ball. When the Wilson Staff dimple pattern is used on a two-piece ball having the same construction as an Ultra golf ball, the resulting ball is significantly shorter than the commercial Ultra ball in both carry and total distance (carry plus roll).

SUMMARY OF THE INVENTION

I have found that excellent results can be obtained with a dimple pattern for two-piece balls in which the depth of the dimples increases as the diameter of the dimples decreases. The aspect ratios of different sized dimples are therefore different, and the aspect ratios are within the range of about 0.025 to 0.055. Each dimple is in the shape of a truncated cone with a bottom surface.

DESCRIPTION OF THE DRAWING

The invention will be explained in conjunction with an illustrative embodiment shown in the accompanying drawings, in which.

DESCRIPTION OF SPECIFIC EMBODIMENT

Figure 1:
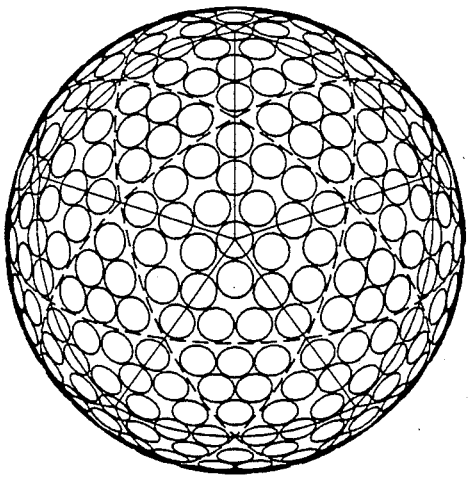
FIG. 1 is a polar view of a prior art golf ball sold under the name Ultra.
Figure 2:
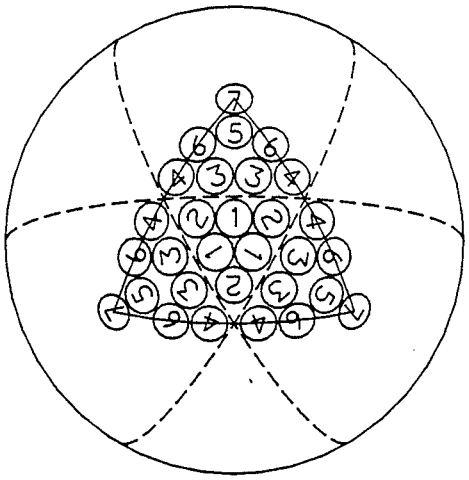
PRIOR ART FIG. 2
FIG. 2 illustrates one of the icosahedral triangles of the prior art golf ball of FIG. 1 and lists the dimple diameter or chord and the depth for each dimple.

FIGS. 1 and 2 represent the dimple pattern of the prior art Ultra golf ball and are essentially reproductions of FIGS. 8A and 8B of U.S. Pat. No. 4,560,168. As explained in that patent, the dimples are arranged in an icosahedral pattern, and the solid lines in FIGS. 1 and 2 represent the sides of icosahedral triangles. The dashed lines are six great circles which bisect the sides of the icosahedral triangles. The dimples are arranged so that they do not intersect the six great circles.

All of the dimples in the prior art ball illustrated in FIGS. 1 and 2 have a constant diameter of 0.135 inch and a constant depth of 0.007 inch. The aspect ratio of the depth divided by the diameter is 0.052.

Figure 3:
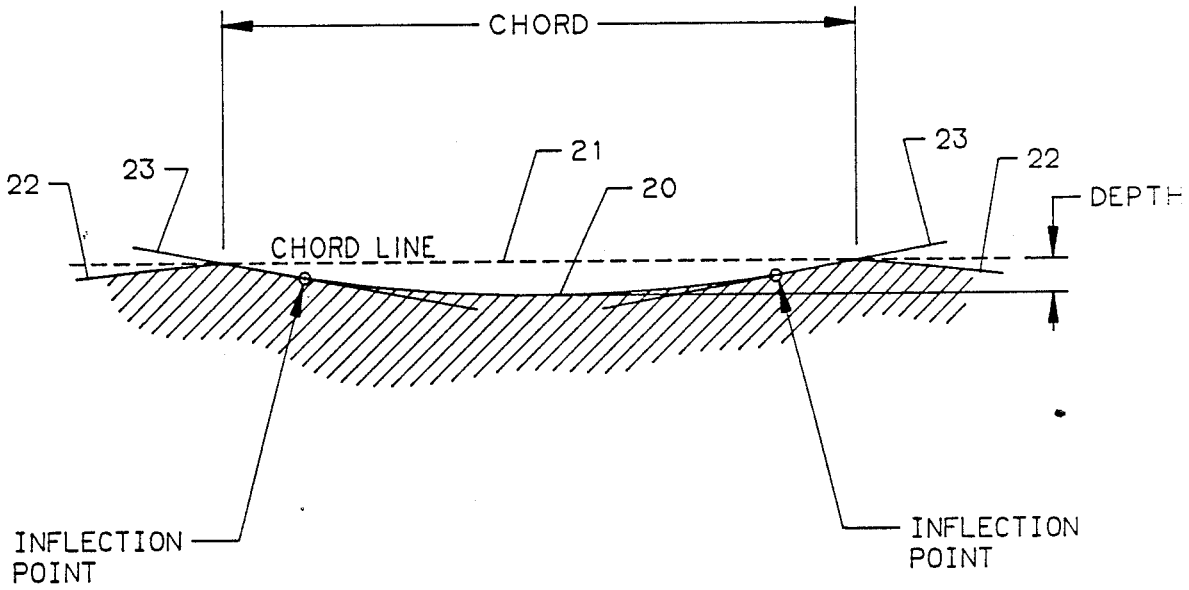
FIG. 3 illustrates the method of determining the dimple diameter or chord and the depth of a dimple.

FIG. 3 illustrates the method of determining the dimple diameter or chord and the depth of a dimple 20 as the terms "diameter" and "depth" are used herein. A chord line 21 is drawn tangent to the spherical ball surface 22 on opposite sides of the dimple. Side wall lines 23 are drawn tangent to the dimple walls at the inflection points of the wall, i.e., where the curvature of the wall changes sign or where the second derivative of the equation for the curve is 0. The intersections of the side wall lines 23 and the chord line 21 define the edges of the dimple and the chord or diameter of the dimple. The depth of the dimple is measured between the chord line and the bottom of the dimple at its center. For a dimple in the shape of a truncated cone, the inflection point is actually a line segment of a discrete length.

Figure 4:
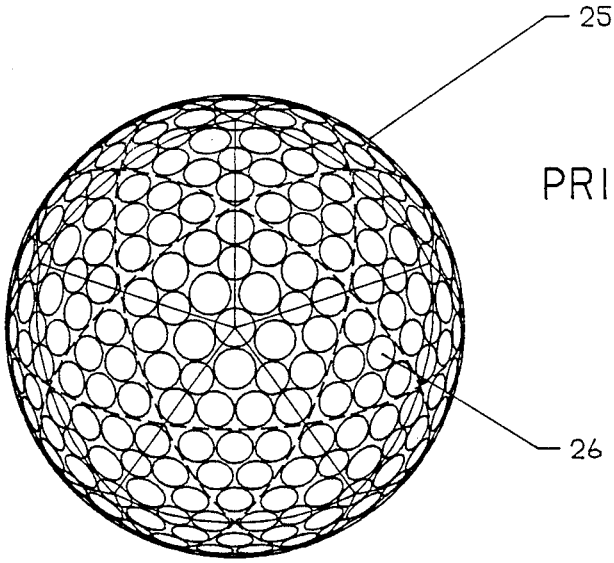
FIG. 4 is a polar view of a prior art golf ball sold under the name Wilson Staff.
Figure 5:
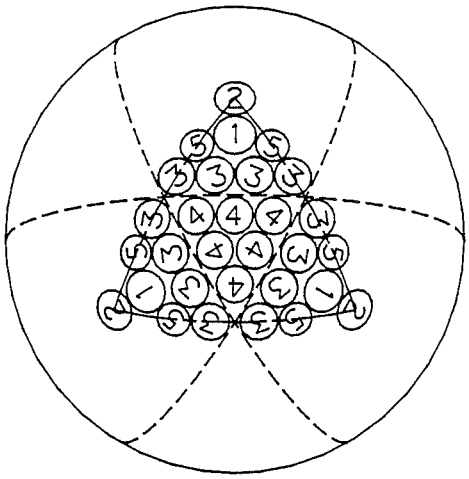
PRIOR ART FIG. 5
FIG. 5 illustrates one of the icosahedral triangles of the prior art golf ball of FIG. 4 and lists the dimple diameter or chord and the depth for each dimple.

FIGS. 4 and 5 represent the dimple pattern of the prior art Wilson Staff golf ball 25. The dimples 26 are arranged in an icosahedral pattern and do not intersect the six great circles which bisect the sides of the icosahedral triangles. There are five different sizes of dimples represented by the dimples numbered 1 through 5 in FIG. 5, and all dimples have the same aspect ratio of 0.046. The diameters and depths of the dimples are set forth in Table I.

TABLE I

| Dimple No. | Diameter (in.) | Depth (in.) | Aspect Ratio |
|---|---|---|---|
| 1 | 0.155 | 0.0071 | 0.046 |
| 2 | 0.150 | 0.0069 | 0.046 |
| 3 | 0.140 | 0.0064 | 0.046 |
| 4 | 0.135 | 0.0062 | 0.046 |
| 5 | 0.125 | 0.0058 | 0.046 |

Figure 6:
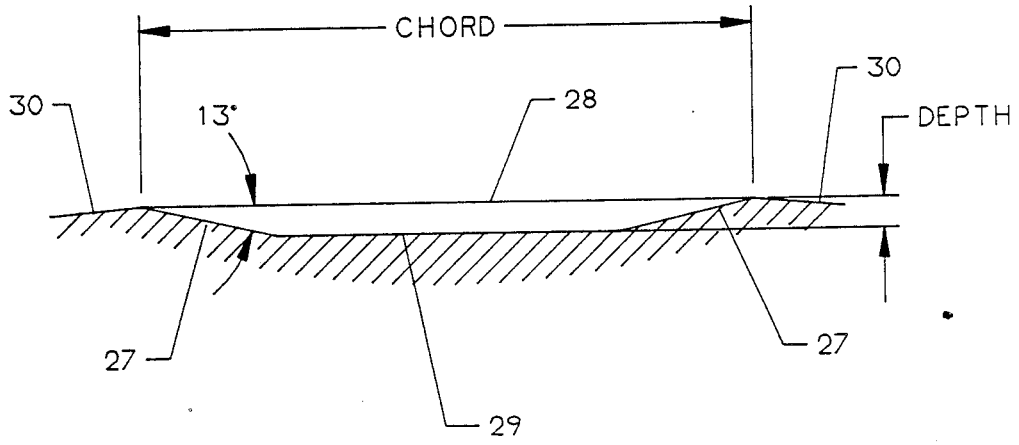
FIG. 6 is a fragmentary cross sectional view through one of the dimples of the prior art golf ball of FIG. 4.

Referring to FIG. 6, the dimples of the Wilson Staff ball are frusto-conical or in the shape of a truncated cone. Each dimple has a conical side surface 27, and the inclination of the side surface relative to the chord line 28 is 13 degrees. Each dimple has a flat bottom surface 29 which extends parallel to the chord line 28. The depth of the dimple is measured from the chord line 28 to the bottom surface 29. The radius of the spherical outer surface 30 is about 0.84 inch.

Figure 7:
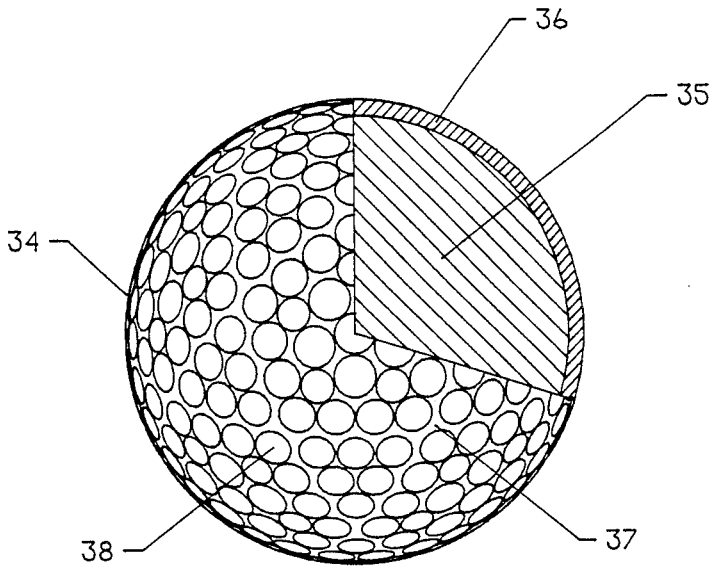
FIG. 7 is a perspective view, partially broken away, of a golf ball formed in accordance with the invention.

The inventive dimple pattern is illustrated in FIGS. 7–10. FIG. 7 shows a two-piece golf ball 34 consisting of a solid core 35 and a cover 36. The cover has an outer spherical surface 37 and a plurality of recessed dimples 38.

Figure 8:
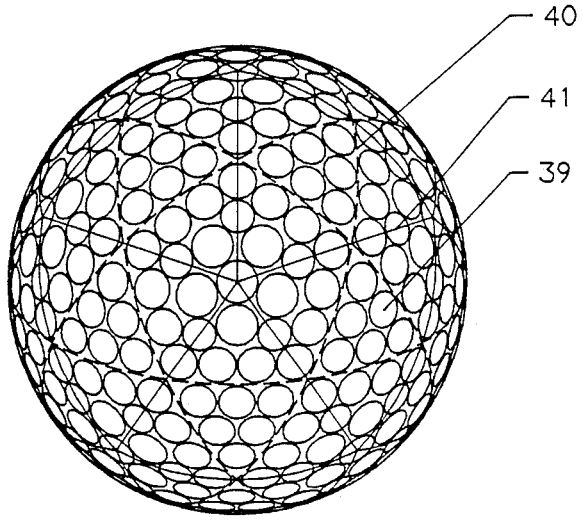
FIG. 8 is a polar view of a golf ball formed in accordance with the invention.
Figure 9:
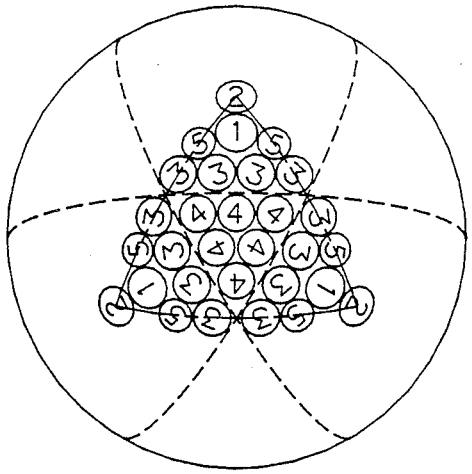
FIG. 9 illustrates one of the icosahedral triangles of the golf ball of FIG. 8 and lists the dimple diameter or chord and the depth for each dimple.

The particular embodiment illustrated in FIGS. 8 and 9 includes 432 dimples 39 arranged in an icosahedral pattern. The dimples do not intersect the six great circles 40 which bisect the sides of the icosahedral triangles 41. There are five different sizes of dimples as indicated in FIG. 9.

Figure 10:
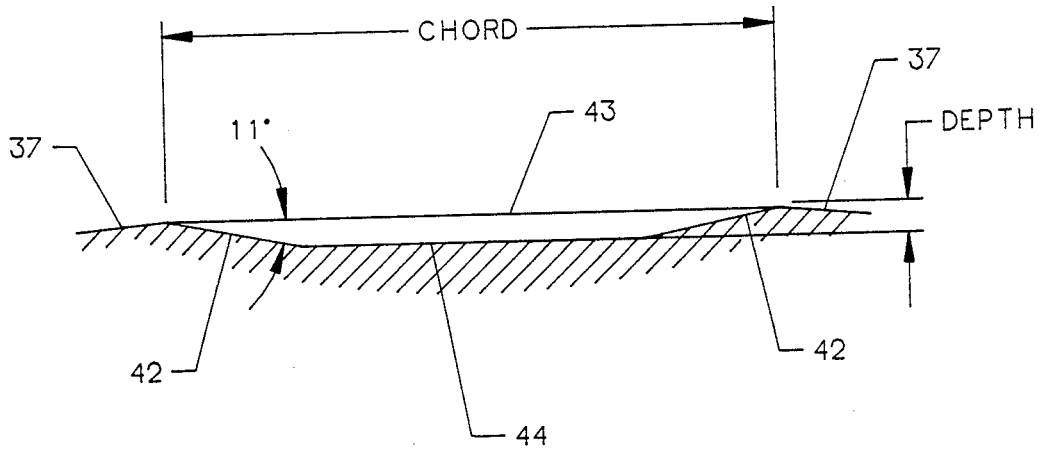
FIG. 10 is a fragmentary cross sectional view through one of the dimples of FIG. 8.

The arrangement and the diameters of the dimples in FIG. 9 are the same as for the Wilson Staff prior art ball. Each dimple is also in the shape of a truncated cone as illustrated in FIG. 10 and includes a side surface 42 which extends at an angle of 11 degrees with respect to the chord line 43 and a flat bottom surface 44.

However, unlike the Wilson Staff ball, the depths of the dimples in FIGS. 7–10 increase as the diameters decrease, and the aspect ratio also increases as the diameter decreases. The measurements of the dimples in FIGS. 7–10 are set forth in Table II.

TABLE II

| Dimple No. | Diameter (in.) | Dept (in.) | Aspect Ratio |
|---|---|---|---|
| 1 | 0.155 | 0.0050 | 0.0323 |
| 2 | 0.150 | 0.0052 | 0.0347 |
| 3 | 0.140 | 0.0054 | 0.0386 |
| 4 | 0.135 | 0.0056 | 0.0415 |
| 5 | 0.125 | 0.0060 | 0.0480 |

The performance of the dimple pattern illustrated in FIGS. 7–10 was demonstrated by comparative tests in which the Ultra commercial golf ball was used as the control. All of the balls were two-piece balls which were constructed in the same way as the Ultra ball and used 432 dimples.

Sample No. 1 was the Ultra prior art golf ball in which the chord and depth was the same for all dimples. Sample No. 2 used the dimple pattern of the prior art Wilson Staff three-piece ball on a two-piece ball. The ball had five different dimples as indicated in Table III. Sample Nos. 3–5 each had five different sized dimples having chords and depths as indicated. Sample No. 6 used the inventive dimple pattern illustrated in FIG. 9. The shape of the dimples for Sample No. 1 was spherical, and the other samples used dimples in the shape of truncated cones.

Table III includes the dimple information for the samples, and Table IV lists the average of the carry distance, roll distance, and total distance for the samples which were hit with a True-Temper golf machine using a metal driver and a club head speed of 150 feet per second. Twenty-four balls of each sample were hit on the same day. One ball from each sample was hit, and then a second from each sample was hit, etc., so that the balls from each sample were subject to substantially the same wind conditions, temperature, etc. Only the balls which landed in the fairway were measured.

TABLE III

| Sample | Chord (in.) | Depth (in.) | Aspect Ratio | Wall Angle (deg.) | Dimple Shape |
|---|---|---|---|---|---|
| No. 1 (Ultra) | 0.135 | 0.0070 | 0.052 | | Spherical |
| No. 2 Wilson Staff) | 0.155 | 0.0071 | 0.046 | 13 | T. cone |
| | 0.150 | 0.0069 | 0.046 | 13 | T. cone |
| | 0.140 | 0.0064 | 0.046 | 13 | T. cone |
| | 0.135 | 0.0062 | 0.046 | 13 | T. cone |
| | 0.125 | 0.0058 | 0.046 | 13 | T. cone |
| No. 3 | 0.155 | 0.0070 | 0.045 | 13 | T. cone |
| | 0.150 | 0.0070 | 0.047 | 13 | T. cone |
| | 0.140 | 0.0070 | 0.050 | 13 | T. cone |
| | 0.135 | 0.0070 | 0.052 | 13 | T. cone |
| | 0.125 | 0.0070 | 0.056 | 13 | T. cone |
| No. 4 | 0.155 | 0.0081 | 0.052 | 13 | T. cone |
| | 0.150 | 0.0078 | 0.052 | 13 | T. cone |
| | 0.140 | 0.0073 | 0.052 | 13 | T. cone |
| | 0.135 | 0.0070 | 0.052 | 13 | T. cone |
| | 0.125 | 0.0065 | 0.052 | 13 | T. cone |
| No. 5 | 0.155 | 0.0062 | 0.040 | 14 | T. cone |
| | 0.150 | 0.0060 | 0.040 | 14 | T. cone |
| | 0.140 | 0.0056 | 0.040 | 14 | T. cone |
| | 0.135 | 0.0054 | 0.040 | 14 | T. cone |
| | 0.125 | 0.0050 | 0.040 | 14 | T. Cone |
| No. 6 | 0.155 | 0.0050 | 0.032 | 11 | T. Cone |
| | 0.150 | 0.0052 | 0.035 | 11 | T. Cone |
| | 0.140 | 0.0054 | 0.039 | 11 | T. Cone |
| | 0.135 | 0.0056 | 0.041 | 11 | T. Cone |
| | 0.125 | 0.0060 | 0.048 | 11 | T. Cone |

TABLE IV

| Sample | No. 1 | No. 2 | No. 3 | No. 4 | No. 5 | No. 6 |
|---|---|---|---|---|---|---|
| Balls in fairway | 21 | 24 | 23 | 22 | 23 | 18 |
| Carry Avg. | 249.3 | 242.3 | 237.0 | 241.3 | 247.0 | 250.7 |
| Roll Avg. | 4.0 | 6.2 | 5.4 | 4.3 | 4.9 | 6.3 |
| Total Avg. | 253.3 | 248.5 | 242.4 | 245.6 | 251.9 | 257.0 |

Table IV indicates that using the dimple pattern of the Wilson Staff golf ball on a two-piece ball (Sample No. 2) provides a ball which is seven yards shorter in carry than the Ultra ball and 4.8 yards shorter in total distance. Sample Nos. 3–5 were also shorter than the Ultra ball in both carry and total distance. Sample No. 3 used dimples of different diameters but the same depth. For Sample Nos. 4 and 5, the depth of the dimples decreased with decreasing diameter.

Sample No. 6 had greater carry and roll than the Ultra ball, and the total distance was 3.7 yards greater than that of the Ultra ball.

The aspect ratios of the truncated cone dimples of FIGS. 7–10 range from 0.0323 to 0.0480. Although other aspect ratios can be used, it is preferred to maintain the aspect ratios within the range of about 0.025 to 0.055. Similarly, the diameters of the preferred dimple pattern range between 0.155 and 0.125 inch, but other dimple diameters could be used. The important feature is the inverse relationship between the diameters and the depths, i.e., as the diameter decreases, the depth increases.

All dimple dimensions referred to herein refer to the mold dimensions or, equivalently, to an unfinished ball as it comes out of the mold rather than to a painted or otherwise finished ball.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A golf ball having a spherical surface with a plurality of sets of dimples formed therein, the dimples of each set having a circular periphery of a different diameter and having a different depth than the dimples of other sets, the depth of the dimples increasing as the diameter of the dimples decreases, the side surface of each dimple being formed by a truncated cone.

2. The golf ball of claim 1 in which the ratio of the depth to the diameter of a dimple increases as the diameter of the dimple decreases.

3. The golf ball of claim 1 in which the ratio of the depth to diameter for each dimple is within the range of 0.025 to 0.055.

4. The golf ball of claim 3 in which there are five sets of dimples.

5. The golf ball of claim 4 in which the ratio of the depth to the diameter of a dimple increases as the diameter of the dimple decreases.

6. The golf ball of claim 1 in which there are five sets of dimples.

7. The golf ball of claim 1 in which there are five sets of dimples, the dimples of the first set having a diameter of about 0.155 inch and a depth of about 0.005 inch, the dimples of the second set having a diameter of about 0.150 inch and a depth of about 0.0052 inch, the dimples of the third set having a diameter of about 0.140 inch and a depth of about 0.0054 inch, the dimples of the fourth set having a diameter of about 0.135 inch and a depth of about 0.0056 inch, and the dimples of the fifth set having a diameter of about 0.125 inch and a depth of about 0.0060 inch.

8. The golf ball of claim 7 in which the bottom of each dimple is a flat surface.

9. A two-piece golf ball comprising a core and a cover having a spherical surface with a plurality of sets of dimples formed therein, the dimples of each set having a circular periphery of a different diameter and having a different depth than the dimples of other sets, the depth of the dimples increasing as the diameter of the dimples decreases, the ratio of the depth to diameter for each set being within the range of 0.03 to 0.05 inch, the side surface of each dimple being formed by a frustum of a cone.

10. The golf ball of claim 9 in which there are five sets of dimples.

11. The golf ball of claim 10 in which the bottom of each dimple is a flat surface.

12. The golf ball of claim 9 in which there are five sets of dimples, the dimples of the first set having a diameter of about 0.155 inch and a depth of about 0.005 inch, the dimples of the second set having a diameter of about 0.150 inch and a depth of about 0.0052 inch, the dimples of the third set having a diameter of about 0.140 inch and a depth of about 0.0054 inch, the dimples of the fourth set having a diameter of about 0.135 inch and a depth of about 0.0056 inch, and the dimples of the fifth set having a diameter of about 0.125 inch and a depth of about 0.0060 inch.

13. The golf ball of claim 12 in which the bottom of each dimple is a flat surface.

14. The golf ball of claim 9 in which the ratio of the depth of a dimple to the diameter of the dimple increases as the diameter of the dimple decreases.

15. The golf ball of claim 14 in which there are five sets of dimples.

* * * * *